US007162180B1

(12) United States Patent
Takizawa et al.

(10) Patent No.: US 7,162,180 B1
(45) Date of Patent: Jan. 9, 2007

(54) ELASTIC ROLLER

(75) Inventors: Yoshio Takizawa, Tokyo (JP); Yuichiro Mori, Kanagawa (JP); Shu Inoue, Kanagawa (JP); Ryuta Tanaka, Kanagawa (JP)

(73) Assignee: Bridgestone Corporation, Tokyo (JP)

( * ) Notice: Subject to any disclaimer, the term of this patent is extended or adjusted under 35 U.S.C. 154(b) by 212 days.

(21) Appl. No.: 09/650,654

(22) Filed: Aug. 30, 2000

(30) Foreign Application Priority Data

Sep. 3, 1999 (JP) ..... 11-249856
Oct. 25, 1999 (JP) ..... 11-302789
Apr. 7, 2000 (JP) ..... 2000/106910

(51) Int. Cl.
*G03G 15/08* (2006.01)
*G03G 15/02* (2006.01)
*G03G 15/20* (2006.01)
*D02G 3/00* (2006.01)

(52) U.S. Cl. ..... 399/103; 399/102; 399/105; 399/176; 399/313; 428/375; 428/377

(58) Field of Classification Search ..... 428/375, 428/377; 355/78; 399/102, 103, 105, 176, 399/279, 313
See application file for complete search history.

(56) References Cited

U.S. PATENT DOCUMENTS 3,152,012 A 10/1964 Schaffert
3,731,146 A 5/1973 Bettiga et al.
4,990,556 A * 2/1991 Shimizu et al. ..... 524/475
5,477,006 A * 12/1995 Imamiya et al. ..... 399/285
5,565,968 A * 10/1996 Sawa et al. ..... 399/286
5,697,027 A * 12/1997 Takagi et al. ..... 399/279
5,751,801 A * 5/1998 Murata et al. ..... 399/176
5,878,313 A * 3/1999 Takagi et al. ..... 399/279
5,903,808 A * 5/1999 Takizawa et al. ..... 399/286
5,991,555 A * 11/1999 Suzumi et al. ..... 399/18
6,067,434 A * 5/2000 Takagi et al. ..... 399/286
6,085,058 A * 7/2000 Goto et al. ..... 399/313
6,195,515 B1 * 2/2001 Fujita et al. ..... 399/103

FOREIGN PATENT DOCUMENTS

JP 58-116559 A 7/1983

* cited by examiner

*Primary Examiner*—Rena Dye
*Assistant Examiner*—Lawrence Ferguson
(74) *Attorney, Agent, or Firm*—Sughrue Mion, PLLC

(57) ABSTRACT

The present invention provides an improved elastic material which is free of roller abrasion when used in development rollers and overcomes disadvantages of the conventional silicone rollers of deterioration in the abrasion resistance, an elastic roller employing such elastic materials, and an electrophotographic apparatus and electrostatic recording apparatus incorporating such rollers. The elastic material satisfies a relationship represented by the following equation:

$$\log\{(Tb \cdot Eb)^{-1}\} \leqq -0.0011(Hd)^2 + 0.1154(Hd) - 5.6$$

where Tb is the tensile strength (N/mm$^2$), Eb is the tension fracture elongation (%) and Hd is the Asker C hardness (°).

Further, the present invention provides a novel developer carrier for use with an imaging apparatus and an imaging apparatus incorporating the developer carrier. The developer carrier includes an electrically conductive elastic layer and is arranged in contact with, or in the proximity of, an imaging body. In the developer carrier, the conductive elastic layer satisfies the equation:

$$0.01 \leqq S \cdot T/Hd \leqq 2.0$$

where S is the compressive permanent set (%), T is the thickness of the elastic layer (mm), and Hd is the Asker C hardness (°).

7 Claims, 2 Drawing Sheets

ELASTIC ROLLER

BACKGROUND OF THE INVENTION

1. Field of the Invention

The present invention relates to elastic materials for use in elastic rollers used in electrophotographic apparatuses or electrostatic recording apparatuses such as photocopiers and printers. The present invention further relates to elastic rollers including an elastic layer formed of said elastic materials and electrophotographic apparatuses and electrostatic recording apparatuses incorporating such elastic rollers. Particularly, the present invention relates to developer carriers such as development roller and imaging apparatuses, and more particularly, to a developer carrier for supplying developers to an imaging body retaining a latent image to form a visible image on the imaging body in an imaging apparatus such as photocopiers and laser printers, wherein the developer carrier is capable of preventing formation of contact marks thereon when the developer carrier tightly fits or contacts a contact member such as a layer forming blade, or the like, and wherein the developer carrier is free of image defects when used in an imaging apparatus. The present invention further relates to an imaging apparatus incorporating such developer carriers.

2. Description of the Related Art

In electrophotographic apparatuses or electrostatic recording apparatuses such as photocopiers, printers and faxes, elastic members including development rollers, feeder rollers, and conveyor rollers play different roles in electrophotographic processes including development, formation of toner layers, cleaning, and feeding and conveying sheets of paper. These elastic members are required to have different properties combined in balance depending on their applications.

Pressure development is a known imaging technique used in electrophotographic imaging apparatus such as photocopiers and printers in which single component toner is provided to an imaging body, such as a photosensitive body, retaining an electrostatic latent image. The toner attaches to the latent image and visualizes the image. Examples of such imaging methods are known from U.S. Pat. No. 3,152,012 and U.S. Pat. No. 3,731,146. In the pressure development, a toner carrier, i.e., a developer carrier, carrying toner is brought into contact with an imaging body, i.e., a photosensitive body, retaining an electrostatic latent image to allow the toner to attach to the latent image to form an image. This makes it necessary for the toner carrier to be made of electrically conductive, elastic materials.

FIG. 2 is a schematic view showing an example of an imaging apparatus employing the pressure development technique. In the pressure development, as shown in FIG. 2, a developer (toner) carrier 1 (developer roller) is disposed between a developer (toner) applying roller 5 for providing developer (toner) and an imaging body 6 (photosensitive body) retaining an electrostatic latent image. When the toner carrier 1, imaging body 6, and toner applying roller 5 rotate in the direction indicated by the respective arrows in FIG. 2, the toner applying roller 5 applies toner 7 to the surface of toner carrier 1 and the toner is made into a thin, uniform layer by a layer forming blade 8. The toner carrier 1 rotates while remaining in contact with the imaging body 6. This allows the thin-layered toner on the toner carrier 1 to attach to a latent image on the imaging body, visualizing the latent image.

The toner image is transferred onto a recording medium such as sheets of paper in a transfer unit, indicated generally by the reference numeral 9. A cleaning unit, indicated generally by the reference numeral 10, may optionally be arranged. A cleaning blade 11 in the cleaning unit 10 removes the toner remaining on the surface of the imaging body after transfer.

In the imaging apparatus employing the pressure development technique, the toner carrier 1 must rotate while remaining in contact with the imaging body 6.

Accordingly, the toner carrier 1, as shown in the schematic cross-sectional view of FIG. 1, is composed of a shaft 2 made of electrically conductive materials such as metals and an electrically conductive elastic layer 3 formed around the shaft 2. The conductive elastic layer 3 is made of conductive elastic materials, the conductivity of which results from conductive agents blended with an elastic rubber or foam, such as silicone rubber, NBR (acrylonitril-butadiene copolymeric rubber), EPDM (ethylene-propylene-diene copolymeric rubber), polyurethane rubber. Also, a coating layer 4, made of resins or the like, may optionally be disposed on the surface of the conductive elastic layer 3 to control chargeability or adhesiveness with respect to the developer 7, or to control friction with the imaging body 6 or layer forming blade 8, or to protect the photosensitive body from contamination by the elastic body.

Another imaging method is also proposed in which developer carried on a developer carrier is caused to leap directly onto an imaging body including paper leaves such as sheets of paper or OHP paper through port-like control electrodes to form an image. Still another method is proposed in which a thin-layered non-magnetic developer is carried on a surface of a sleeve-like developer carrier which is arranged closely to an imaging body (photosensitive body) without contacting it. The developer is caused to leap onto the photosensitive body to develop an image. An example of such methods is disclosed in Japanese Patent Laid-open Publication No.58-116559.

When toner carriers of the type described above are used in imaging apparatuses, however, lateral lines spaced at a constant cycle may appear on the image, depending on the particular condition in which the imaging apparatus is used. This is considered due to contact marks formed on a surface of the toner carrier upon contact with a contact member such as a layer forming blade. It is known that, in order to reduce the contact marks, the compressive permanent set of an elastic body that forms the toner carrier needs to be lower than a predetermined value.

In the field of the development roller used in photocopiers and printers, there is also a need for rollers that are less susceptible to abrasion than conventional rollers in order to prevent leakage of toner due to rollers abraded in the area contacting a toner sealing member.

Recently, silicone rollers made of silicone-based materials such as silicone rubber have become commonly used as development rollers that are free of the above-mentioned problem associated with roller abrasion. One drawback of these conventional rollers, however, is that, although having solved the problem of roller abrasion, these rollers have an insufficient durability since silicone materials have a relatively low abrasion resistance.

SUMMARY OF THE INVENTION

The present invention addresses the above-mentioned problem. Accordingly, it is an object of the present invention to provide an improved elastic material that can provide abrasion-free rollers when used in such rollers as development rollers used in electrophotographic apparatuses and electrostatic recording apparatuses and is free of deterioration in the abrasion resistance, which is a problem associated with the above-described conventional silicone rollers. Another object of the present invention is to provide an elastic roller using the aforementioned elastic material. A further object of the present invention is to provide an electrophotographic apparatus and electrostatic recording apparatus employing such elastic rollers.

An another object of the present invention is to provide a developer carrier with a conductive elastic substrate layer which can prevent formation of contact marks thereon when the developer carrier tightly fits or contacts a contact member such as a layer forming blade and is free of image defects when used in imaging apparatuses. The present invention also provides an imaging apparatus incorporating such a developer carrier.

In an effort to solve the above-mentioned problems, the present inventors have discovered that elastic materials for rollers that have better performances than the conventional silicone materials and are free of roller abrasion can be obtained when the hardness, tensile strength, and tension fracture elongation of the roller materials satisfy a certain relationship. The present inventors have also discovered that a developer carrier can provide a solution to the above-described problems when the compressive permanent set S (%), thickness T (mm), and Asker C hardness Hd (°) of the conductive elastic layer of the developer carrier satisfy a certain relationship. The present invention is provided based on the above discovery.

Accordingly, the present invention provides an elastic material which comprises satisfying a relationship represented by the following equation (1):

$$\log\{(Tb\cdot Eb)^{-1}\}\leqq -0.0011(Hd)^2+0.1154(Hd)-5.6 \quad (1)$$

where Tb is the tensile strength (N/mm$^2$), Eb is the tension fracture elongation (%) and Hd is the Asker C hardness (°), an elastic roller which has a shaft and an elastic layer disposed about the shaft, wherein the aforementioned elastic material is used as the elastic layer, an electrophotographic apparatus which comprises an elastic roller and an electrostatic latent image carrier for carrying a latent image, wherein the aforementioned elastic roller is used as the elastic roller, and an electrostatic recording apparatus which comprises an elastic roller and an electrostatic latent image carrier for carrying a latent image, wherein the aforementioned elastic roller is used as the elastic roller.

The elastic materials of the present invention will not suffer from the problem of roller abrasion when used in development roller or the like in electrophotographic apparatuses and electrostatic recording apparatuses. The elastic materials of the present invention also have an improved abrasion resistance. Accordingly, an improved roller is achieved which is free of toner leakage when in use.

Further, the present invention provides a developer carrier comprising an electrically conductive elastic layer and arranged in contact with, or in the proximity of, an imaging body, wherein a thin layer of developer is formed on a surface of the conductive elastic layer and the developer is supplied onto a surface of the imaging body to form a visible image, wherein the electrically conductive elastic layer satisfies the equation (3):

$$0.01\leqq S\cdot T/Hd\leqq 2.0 \quad (3)$$

where S is the compressive permanent set (%), T is the thickness of the elastic layer (mm), and Hd is the Asker C hardness (°)

Furthermore, the present invention provides an imaging apparatus incorporating a developer carrier arranged in contact with, or in the proximity of, an imaging body, wherein a thin layer of developer is formed on a surface of the developer carrier and the developer is supplied onto a surface of the imaging body to form a visible image, the imaging apparatus being characterized by employing the above-described developer carrier.

BRIEF DESCRIPTION OF THE DRAWINGS

These and other objectives and advantages of the present invention will become apparent from the following description with reference to the accompanying drawings, wherein.

DESCRIPTION OF THE PREFERRED EMBODIMENTS

Figure 1:
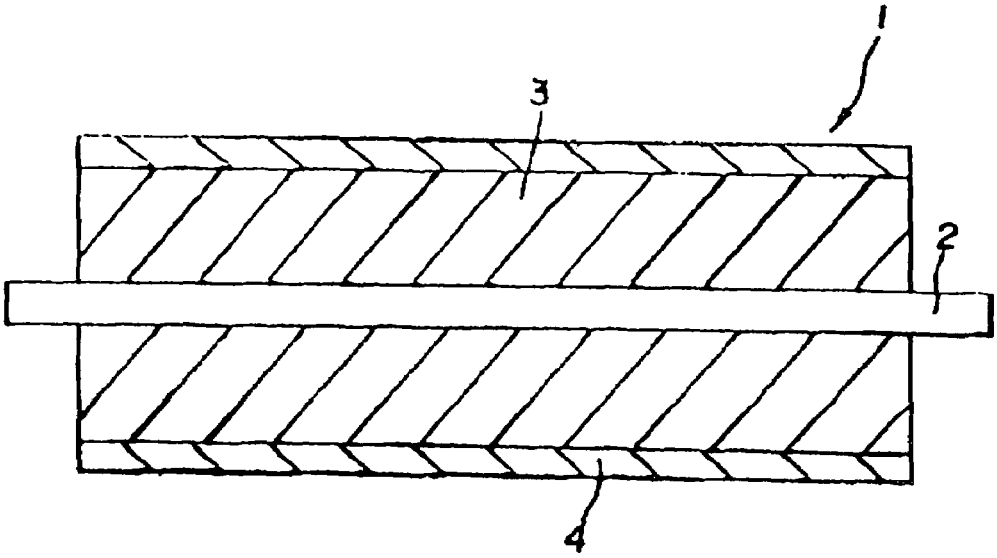
FIG. 1 is a schematic cross-sectional view showing an embodiment of a carrier developer of the present invention.

The present invention will now be described in detail with reference to the accompanying drawings.

The elastic material according to the present invention satisfies a relationship represented by the following equation (1):

$$\log\{(Tb\cdot Eb)^{-1}\}\leqq -0.0011(Hd)^2+0.1154(Hd)-5.6 \quad (1)$$

and preferably a relationship represented by the following equation (2):

$$\log\{(Tb\cdot Eb)^{-1}\}\leqq -0.0011(Hd)^2+0.1154(Hd)-5.7 \quad (2)$$

where Tb is the tensile strength (N/mm$^2$), Eb is the tension fracture elongation (%) and Hd is the Asker C hardness (°).

The problem of abrasion in rollers such as development rollers used in electrophotographic apparatus or electrostatic recording apparatuses can be overcome and an improvement in the abrasion resistance of the rollers can be achieved only when the above relationship is satisfied, regardless of the kind of elastic materials used.

The elastic material according to the present invention has an Asker C hardness Hd in a range from 40° to 80°, preferably from 50° to 80°. With the value less than 40°, the contact force is decreased and the stable contact with other objects will be lost because of a decreased circularity. Conversely, with an Asker C hardness Hd greater than 80°, the shape conformity to the objects the material is brought into contact is decreased, making it difficult to maintain stable contact.

The elastic material according to the present invention preferably has a tensile strength Tb greater than, or equal to, 0.8N/mm$^2$. With this value less than 0.8N/mm$^2$, the abrasion resistance is decreased, lowering the durability. Further, the tension fracture elongation Eb is preferably 50% or more. With this value less than 50%, the material becomes susceptible to cracking.

Thus, it is important that the elastic material according to the present invention has an Asker C hardness Hd, tensile strength Tb, and tension fracture elongation Eb which satisfy the aforementioned relationship. Concrete materials and blending ratios are not particularly limited, but examples of preferred materials include urethane materials comprising polyol components and polyisocyanate components.

Polyol components which may be used in the present invention include those used in the production of common soft or hard polyurethane foams or urethane elastomers, for example, polyether polyols or polyester polyols having terminal polyhydroxy groups, polyether polyester polyols that are copolymers of the first two, and common polyols such as polyolefin polyols including polybutadiene polyols and polyisoprene polyols, and so-called polymer polyols obtained through the polymerization of ethylene unsaturated monomers in polyols.

Similarly, examples of polyisocyanate component include those used in the production of common soft polyurethane foams or urethane elastomers, for example, polymeric MDIs such as trirene-diisocyanate (TDI), crude TDI, 4,4-diphenyl methanediisocyanate (MDI), crude MDI and polymethylene-polyphenyl-polyisocyanates, aliphatic polyisocyanates having 2 to 18 carbons, alicyclic polyisocyanates having 4 to 15 carbons and mixtures of these polyisocyanates or denatured products including pre-polymers obtained by partial reactions with polyols.

The conductive agents may be ionic conductive agents or electron conductive agents. Examples of the ionic conductivity agents include: ammonium salts including perchlorates, chlorates, hydrochlorides, bromates, iodates, hydroborofluorides, sulfates, ethylsulfates, carboxylates, sulfonates of tetraethylammonium, tetrabutylammonium, dodecyltrimethylammonium (e.g., lauryltrimethylammonium), hexadecyltrimethylammonium, octadecyltrimethylammonium (e.g., stearyltrimethylammonium), benzyltrimethylammonium, denatured fatty acid-dimethylethylammonium; and alkali salts or salts of alkaline earth metals including perchlorates, chlorates, hydrochlorides, bromates, iodates, hydroborofluorides, trifluoromethylsulfates, and sulfonates of lithium, sodium, potassium, calcium, and magnesium.

Examples of electron conductive agents include: electrically conductive carbons such as Kechen black and acetylene black; carbons for use with rubbers including SAF, ISAF, HAF, FEF, GPF, SRF, FT, and MT; oxidized ink carbons, pyrolytic carbons, graphites; electrically conductive metal oxides including tin oxide, titanium oxide, zinc oxide; and metals such as nickel and copper. These conductive agents may adequately be added to adjust a desired electrical resistance.

In order to be used in electrophotographic or electrostatic recording mechanisms, the volume resistivity of the conductive elastic materials of the present invention is not limited to, but preferably adjusted to a value in a range from $1\times10^3$ to $1\times10^{11}$ Ω·cm when applied a voltage of 500V at a temperature of 22° C. and at a humidity of 55% RH, by properly selecting from the aforementioned conductivity-providing agents or adjusting their amounts to be added. In such a case, the conductivity-providing agents may preferably be ionic conductivity-providing agents including the above-mentioned ionic inorganic substances such as lithium perchlorate and sodium perchlorate or ionic organic substances such as quaternary ammonium salts, and 0.0001 to 10 weight parts of the agents are preferably added to 100 weight parts of urethane resin to adjust the conductivity. This results in an improved conductive elastic material with extremely small deviation in the resistivity without sacrificing the resin properties.

As described above, the elastic materials of present invention are suitable for use as an elastic material for elastic members in electrophotographic apparatuses or electrostatic recording apparatuses. In particular, the materials are suitable for use as an elastic material for elastic members such as various rollers that are used either in contact with or without contacting an electrostatic latent image carrier such as a photosensitive drum. For example, the elastic material of the present invention is appropriately used for the above-described elastic layer such as an elastic layer 3 as shown in FIG. 1 which is disposed about a shaft 2 to form an elastic roller 1.

Preferably, the shaft 2 is not particularly limited, but a solid metal core or a highly conductive metal shaft formed as a hollow metal cylinder. The elastic layer 3 may be formed as either a single-layered structure consisting only of the elastic material of the present invention or a multi-layered structure including layers formed of other elastic materials. In the case of the multi-layered structure, the elastic material of the present invention forms the outermost layer. Elastic materials that can be used to form the layers other than that formed of the material of the present invention include rubbers such as common rubbers including nitrile butadiene rubber, natural rubber, butyl rubber, nitrile rubber, isoprene rubber, polybutadiene rubber, silicone rubber, styrene-butadiene rubber, ethylene-propylene rubber, ethylene-propylene-dien terpolymer rubber (EPDM), chloroprene rubber and polynorbornene rubber; thermoplastic rubbers including stylene-butadiene-stylene (SBS) and stylene-butadiene-stylene hydrides (SEBS); copolymeric rubbers of polyethylene chrolosulfonate, epichlorohydrin and ethylene oxide; and polyurethane resins other than those of the present invention to which conductivity-providing agents have been added when necessary.

The elastic roller 1 using the elastic materials of the present invention are suitably used as a roller such as a development roller that is used in contact with or without contacting a latent image carrier, in particular, a photosensitive drum which forms electrostatic latent images on its surface and comprises organic photosensitive body or amorphous photosensitive body, in electrophotographic apparatuses or electrostatic recording apparatuses.

Figure 2:
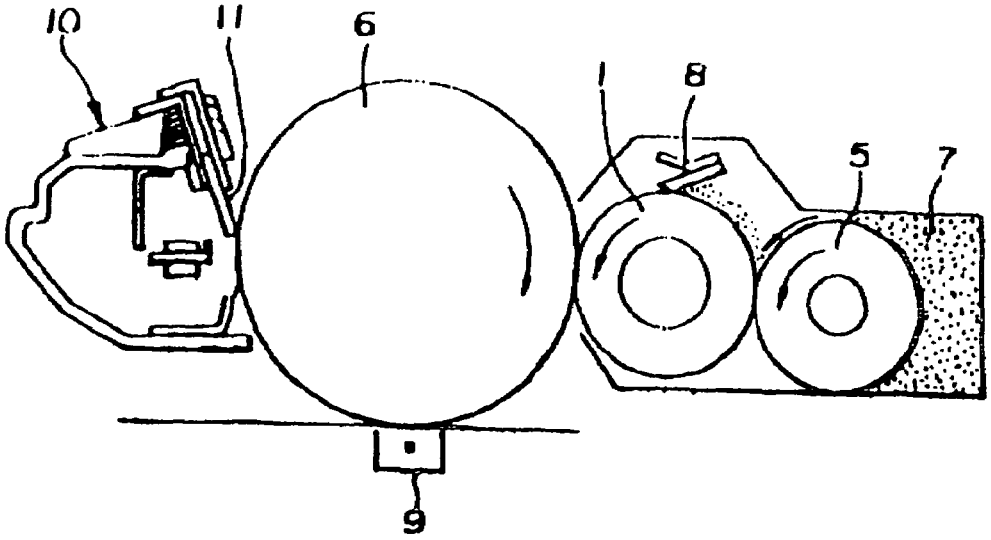
FIG. 2 is a schematic view showing an embodiment of an imaging apparatus of pressure development technique type.

An example of a development assembly employing the elastic roller 1 according to the present invention as its development roller is shown in FIG. 2. In this respect, the employment of the elastic roller using the elastic materials of the present invention as the development roller 1 ensures that the stable contact remains between the development roller 1 and the photosensitive drum 6 both in a stationary state and in operation. It also prevents unfavorable influences on the photosensitve drum 6 such as contamination and corrosion as well as non-uniformity and deviation in different properties (e.g., conductivity) of the development roller 1, ensuring stable printing operations over a long period of time.

As will be recognized, while the elastic materials of the present invention are preferably used as elastic materials for elastic members in electrophotographic apparatuses and electrostatic recording apparatuses, in particular, for rollers that are used either in contact with or without contacting a latent image carrier such as a development roller, the elastic materials of the present invention may also be used in other roller members such as charge rollers and transfer rollers, or in elastic members other than rollers. Further, the elastic materials of the present invention may also preferably be used in various elastic members for use in applications other than electrophotographic apparatus and electrostatic recording apparatus.

A developer carrier in accordance with the present invention, as shown in FIG. 1, is configured by forming an electrically conductive elastic layer 3 around an electrically conductive shaft 2 or the like. A resin coating layer 4 may optionally be formed on the surface of the conductive elastic layer 3. As used herein, the term "electrically conductive elastic layer" refers to an electrically conductive elastic layer that is disposed about a shaft or the like.

The conductive elastic layer 3 is formed of an elastic material obtained by adding conductive agents to a proper rubber-like elastic material to provide the material with an electrical conductivity. The rubber-like elastic materials can be any materials that are commonly used in conventional developer carriers. Examples of such rubber-like elastic materials include, but are not limited to, nitrile rubber, ethylene-propylene rubber, ethylene-propylene-diene rubber, styrene-butadiene rubber, butadiene rubber, isoprene rubber, natural rubber, silicone rubber, urethane rubber, acrylic rubber, chloroprene rubber, butyl rubber, epichlorohydrin rubber. These rubbers may be used individually or in combination of more than two rubbers. Among these rubbers, nitrile rubber, urethane rubber, epichlorohydrin rubber, ethylene-propylene rubber, ethylene-propylene-diene rubber, silicone rubber are especially preferred. Use may be made of the aforementioned conductive agents.

The above conductive agents may be used either individually or in combination of more than two kinds thereof. In case of the above-mentioned ionic conductive agents, the amount of the agents to be added is not particularly limited, but typically in a range from 0.01 to 5 weight parts, preferably from 0.05 to 2 weight parts, with respect to 100 weight parts of the aforementioned rubber-like elastic materials. For the electron conductive agents, the amount of the agents to be added is typically in a range from 1 to 50 weight parts, preferably from 5 to 40 weight parts, with respect to 100 weight parts of the rubber-like elastic materials. Through the addition of the conductive agents, the resistance of the conductive elastic layer is preferably adjusted to a value with the order of from $10^3$ to $10^{10}$ Ω·cm, and more preferably with the order from $10^4$ to $10^8$ Ω·cm. In addition to the conductive agents, other agents for use with rubbers such as known fillers or cross-linking agents may optionally be added to the conductive elastic layers.

In the present invention, it is necessary that the conductive elastic layer satisfy the following equation (3):

$$0.01 \leqq S \cdot T/Hd \leqq 2.0 \quad (3)$$

wherein S is the compressive permanent set (%), T is the thickness of the layer (mm), and Hd is the Asker C hardness (°).

When the quantity S·T/Hd has a value less than 0.01, an insufficient contact results between the imaging body and the developer carrier, causing non-uniformity in the resulting image. Furthermore, developer carriers or contact members are more likely to be subjected to damage such as scratches when used in an imaging apparatus since greater stress applies due to the contact with the contact members including the imaging body. This may lead to image defects. Conversely, when the quantity S·T/Hd has a value greater than 2.0, contact marks tend to appear on the developer carrier when it is used in an imaging apparatus. This also results in image defects. In the present invention, the quantity S·T/Hd preferably has a value in a range from 0.02 to 1.5, and more preferably in a range from 0.025 to 1.0. For example, when T=3 mm and Hd=65°, it is preferred that 0.43%≦S≦32.5%, and it is more preferred that 0.54%≦S≦21.7%. When T=4 mm and Hd=55°, it is preferred that 0.28%≦S≦20.6%, and it is more preferred that 0.34%≦S≦13.8%.

In the present invention, when the conductive elastic layer has too high an Asker C hardness, the developer carrier may become excessively stiff, making the area that contacts the photosensitive body too small for proper imaging. This increases the likelihood that the developers are damaged, which may lead to problematic situations that can cause image defects such as adhesion of the agents to the photosensitive body or layer forming blade. Conversely, with a hardness that is too low, the compressive permanent set may become excessive. This not only causes non-uniformity in the resulting image but also may cause insufficient contact with the resin coating layer when the developer carrier experiences deformation or eccentricity under certain condition. For these reasons, the Asker C hardness is preferably in a range from 30° to 80°, more preferably in a range from 40° to 70°.

In the present invention, preferred thickness of the conductive elastic layer is from 1 to 5 mm, particularly from 2 to 4 mm.

Preferred surface roughness of the conductive elastic layer is 15 μmRz or less, more preferably from 1 to 10 μmRz, in the 10-point scale JIS standard of average thickness. An average roughness greater than 15 μmRz makes it difficult to obtain uniform thickness of the developer layer and to charge the layer uniformly even when the coating layer is formed. This may lead to image defects.

Developer carriers according to the present invention preferably include a resin coating layer disposed on the surface of the electrically conductive substrate, i.e., the above-described conductive layer. The purposes of the resin coating layer are to control chargeability or adhesiveness with respect to the developers, to reduce friction with the imaging body or layer forming blade, or to protect the photosensitive body from contamination by the elastic body.

Thickness of the resin coating layer is preferably in a range from 1 to 100 μm. With a thickness less than 1 μm, formation of the coating layer is insufficient, which may lead to a loss of the coating layer after repeated printing. The coating layer with a thickness greater than 100 μm stiffens the developer carrier and may cause damage to developers, leading to problematic situations that can cause image defects such as adhesion of the agents to the photosensitive body or layer forming blade. For these reasons, the preferred thickness of the resin coating layer is from 5 to 30 μm.

When provided in the developer carrier of the present invention, the coating layer preferably has a specific resistance with an order from $10^3$ to $10^6$ Ω·cm, particularly from $10^6$ to $10^{13}$ Ω·cm. Preferably, the developer carrier has a resistance with an order from $10^2$ to $10^{12}$Ω, particularly from $10^4$ to $10^{10}$Ω.

Preferably, the developer carrier with a resin coating layer formed thereon has a surface roughness of 10 μmRz or less, particularly from 1 to 8 μmRz, in accordance with the 10-point scale JIS standard of average thickness. With a surface roughness greater than 10 μmRz, the degree to which the developers are charged may be decreased and some of the developer may be charged oppositely, resulting in a fogged image. Conversely, when the value of Rz is too small, the carried amount of the developer may be decreased, resulting in a reduced image density.

A preferred type of resin that can compose the above-mentioned resin coating layer is cross-linking resins. Of these cross-linking resins, those that have 70 wt % or more of insoluble part when dissolved in a solvent (e.g., acetone)

are preferred. When a resin with less than 70 wt % of insoluble part is used, the members that are in contact with the developer carrier, including the imaging body or layer forming blade, may leave indentations on the developer carrier especially when they are not in use for a prolonged period. This may result in horizontal black lines in the resulting image. Accordingly, cross-linking resins with 80 wt % or more of insoluble part are especially preferred.

As used herein, the term "cross-linking resin" refers to resins that undergo a self-cross-linking reaction when subjected to heat, catalysts, air (oxygen), moisture (water), electron beam or the like or resins that react with cross-linking agents or other cross-linking resins to form cross-linkages.

Examples of such cross-linking resins include fluororesins, polyamide resins, acrylic urethane resins, alkyd resins, phenol resins, melamine resins, silicone resins, urethane resins, polyester resins, polyvinyl acetal resins, epoxy resins, polyether resins, amino resins, acrylic resins, urea resins and mixtures thereof, each of the resins having functional groups such as hydroxy, carboxyl, acid anhydride, amino, imino, isocyanate, methylol, alkoxymethyl, aldehyde, mercapto, epoxy, or unsaturated group. Of those resins, fluororesins, polyamide resins, acrylic urethane resins, alkyd resins, phenol resins, melamine resins, silicone resins, urethane resins, polyester resins, polyvinyl acetal resins, epoxy resins, and mixtures thereof are preferred, and particularly alkyd resins, phenol resins, melamine resins, or mixtures thereof are preferred in that they provide optimum conditions with respect to chargeability of developers, anti-comtamination effect for developers, reduced friction with other members, and anti-contamination effect for the imaging body.

Catalysts or cross-linking agents may optionally be used in conjunction with the above-described cross-linking resins. Such catalysts include acid catalysts, basic catalysts, or radical catalysts including peroxides and azo compounds. The cross-linking agents may be the compounds having a molecular weight of less than 1000, preferably of less than 500, and having two or more functional groups within a molecule such as hydroxy, carboxyl, acid anhydride, amino, imino, isocyanate, methylol, alkoxymethyl, aldehyde, mercapto, epoxy, or unsaturated group. Examples of such compounds include polyol compounds, polyisocyanate compounds, polyaldehyde compounds, polyamine compounds, and polyepoxy compounds.

These cross-linking resins may also contain various additives including charge control agents, slip additives, conductive agents or other resins for the purposes of further increasing chargeability of developers, reducing friction with other members, or providing electrical conductivity.

Processes for forming a resin coating layer on the developer carrier of the present invention are not particularly limited, but typically involve applying a liquid coating, into which the cross-linking resins, cross-linking agents, and various additives have been dissolved or dispersed, onto the conductive elastic layer using techniques such as dipping, roll coater, doctor blade, or spraying, and then drying the liquid coating at room temperature or at a temperature from 50° C. to 170° C. to allow the coating to form cross-linkages and thus harden.

Solvents used for the preparation of the liquid coating mentioned above include alcohol solvents such as methanol, ethanol, isopropanol and butanol; ketone solvents such as acetone, methylethylketone and cyclohexanone; aromatic hydrocarbon solvents such as toluene and xylene; aliphatic hydrocarbon solvents such as hexane; alicyclic hydrocarbon solvents such as cyclohexane; ester solvents such as ethyl acetate; ether solvents such as isopropyl ether and tetrahydrofuran; amide solvents such as dimethyl formamide; halogenated hydrocarbon solvents such as chloroform and dichloroethane; and mixtures thereof.

The present invention also provides imaging apparatus incorporating the above-described developer carrier.

The imaging apparatus according to the present invention mat be of the types including, but not limited to, (1) those employing pressure development technique in which a developer carrier carrying developer is brought into contact with an imaging body (photosensitive body) retaining an electrostatic latent image to allow the developer to attach to the latent image to form an image; (2) those employing a technique in which a developer carried on a developer carrier is caused to leap directly onto an imaging body such as a sheet of paper through port-like control electrodes to form an image; and (3) those employing a technique in which a thin-layered non-magnetic developer is carried on a surface of a sleeve-like developer carrier which is arranged closely to an imaging body (photosensitive body) without contacting it, and the developer is caused to leap onto the photosensitive body to form an image.

In one embodiment of the imaging apparatus of the present invention, as shown in FIG. 2 above, apparatus of the type employing the pressure development is described.

As has been described, according to the present invention, there is provided an improved elastic material which is free of roller abrasion when used in development rollers and has overcome the drawbacks associated with the aforementioned silicone rollers. Also provided are an elastic roller employing such elastic materials, and electrophotographic apparatus and electrostatic recording apparatus incorporating such rollers.

The developer carrier of the present invention comprise a resin coating layer formed on the surface of a conductive elastic substrate and have advantages over conventional developer carriers in that better contact is achieved between the conductive elastic substrate and the resin coating layer and in that cracking of the resin coating layer is prevented in a prolonged use. The developer carriers of the present invention also have an improved durability and can be used advantageously in various imaging apparatuses.

EXAMPLES

The present invention will now be described in further detail hereinafter by way of examples which are intended to be only illustrative and therefore not restrictive.

Preparation of Elastic Materials

Examples 1 to 4 and Comparative Examples 1 to 4

The elastic materials were obtained as follows. The polyol components designated by A to G in Table 1 below, polyisocyanate components designated by a to d, and a proper amount of dibutyl tin dilaurate as a catalyst for polymerization were mixed with mixing ratios as shown in Table 1. After stirred, the mixtures were poured in metal molds conditioned to 50° C., left at 100° C. for 1 hour, and removed from the molds to obtain the elastic materials. In each example, the mixing ratio of polyol components to polyisocyanate components was adjusted such that the molar ratio of active NCO groups to active OH groups, i.e., the number of mols of active NCO groups/the number of mols of active OH groups, is equal to a value of 1.05. In Table 1, the mixing ratios of the polyol components and the polyisocyanate components were expressed in percentages by weight of each polyol component with respect to the total polyol component and in percentages by weight of each polyisocyanate component with respect to the total polyisocyanate component, respectively.

Example 5

The elastic material as a silicone elastomer was obtained as follows. A proper amount of 2,5-dimethyl-2,5-di(tert-butylperoxy)-hexane as a cross-linking agent was added to the silicone material designated by H in Table. 1 below. The mixture was kneaded and pressure-cured for 10 minutes in a mold heated to 170° C. The material was then removed from the mold and was cured in an oven at 200° C. for 4 hours.

The development roller 11 was tested for whether it would cause a toner leakage or not, due to abrasion of the roller 11, during a test run in which 2000 sheet-equivalent characters were printed. Rollers that resulted in no toner leakage are denoted by N, and those resulted in toner leakage are denoted by L.

The results are shown in Table 1 below. Also shown in Table 1 are values of $\log\{(Tb \cdot Eb)^{-1}\}$ and $-0.0011(Hd)^2+0.1154(Hd)-5.6$ which are calculated from the above-described tensile strength Tb, tension fracture elongation Eb, and Asker C hardness Hd.

TABLE 1

| | | Average molecular weight | Average number of functional groups | Example 1 | Example 2 | Example 3 | Example 4 | Example 5 | Comparative example 1 | Comparative example 2 | Comparative example 3 | Comparative example 4 |
|---|---|---|---|---|---|---|---|---|---|---|---|---|
| Polyol components (%) | A | 10000 | 3.2 | — | — | — | — | — | — | — | 100 | — |
| | B | 10000 | 2.0 | — | 50 | 50 | — | — | — | — | — | — |
| | C | 5000 | 2.8 | 100 | — | — | 100 | — | — | — | — | — |
| | D | 5000 | 3.0 | — | 50 | 50 | — | — | 90 | — | — | — |
| | E | 2800 | 2.3 | — | — | — | — | — | — | 100 | — | 100 |
| | F | 400 | 2.8 | — | — | — | — | — | 10 | — | — | — |
| | G | 90 | 2.0 | 3 | 2 | 1 | — | — | — | — | — | — |
| H | | Silicone rubber | | — | — | — | — | 100 | — | — | — | — |
| Polyisocyanate components (%) | a | | 2.8 | — | — | — | — | | 100 | — | 100 | 10 |
| | b | | 2.3 | — | — | — | — | | — | 100 | — | — |
| | c | | 2.0 | 100 | 100 | 100 | 100 | | — | — | — | — |
| | d | | 2.0 | — | — | — | — | | — | — | — | 90 |
| Resin properties | | Tensile strength Tb ($N/mm^2$) | | 3.7 | 2.8 | 1.8 | 1.5 | 3.2 | 2.1 | 1.9 | 1.6 | 0.98 |
| | | Fracture elongation Eb (%) | | 400 | 390 | 330 | 500 | 580 | 80 | 230 | 100 | 380 |
| | | Asker C hardness Hd (°) | | 73 | 63 | 60 | 45 | 58 | 78 | 68 | 68 | 58 |
| | | $\log\{(Tb \cdot Eb)^{-1}\}$ | | −3.17 | −3.04 | −2.77 | −2.88 | −3.27 | −2.23 | −2.64 | −2.20 | −2.57 |
| | | $-0.0011(Hd)^2 + 0.1154Hd-5.6$ | | −3.04 | −2.70 | −2.64 | −2.63 | −2.61 | −3.29 | −2.84 | −2.84 | −2.61 |
| Rating | | Seal performance | | ○ | ○ | ○ | ○ | ○ | X | X | X | X |

Preparation of Elastic Rollers

Each blend of the resin materials of examples 1 to 5 and comparative examples 1 to 4 was poured into a cylindrical mold having an inner diameter of 20 mm and having a stainless steel shaft with a diameter of 12 mm placed at the center thereof. The materials were allowed to cure at 100° C. for 1 hour and were removed from the molds. The molded materials were then finished to make elastic rollers by grinding on a cylindrical grinder. The finished roller had an elastic layer formed about the 12 mm shaft over a length of 230 mm and had an external diameter of 18 mm.

The resin properties of the elastic materials obtained from the above examples and the comparative examples were measured as described in (I) and (II) below, and each of the elastic rollers was tested as described in (III) below.

(I) Tensile Strength Tb and Tension Fracture Elongation Eb

A sheet with a thickness of 2 mm was made from each of the materials, and each sheet was tested according to the JIS-K6301 standard.

(II) Asker C Hardness Hd

A sheet with a thickness of 5 mm was made from each of the materials, and the hardness of each sheet was measured while applying a load of 9.8N, using the Asker C hardness meter manufactured by Kobunshi Keiki Co., Ltd.

(III) Evaluation of Sealing Performance

Figure 3:
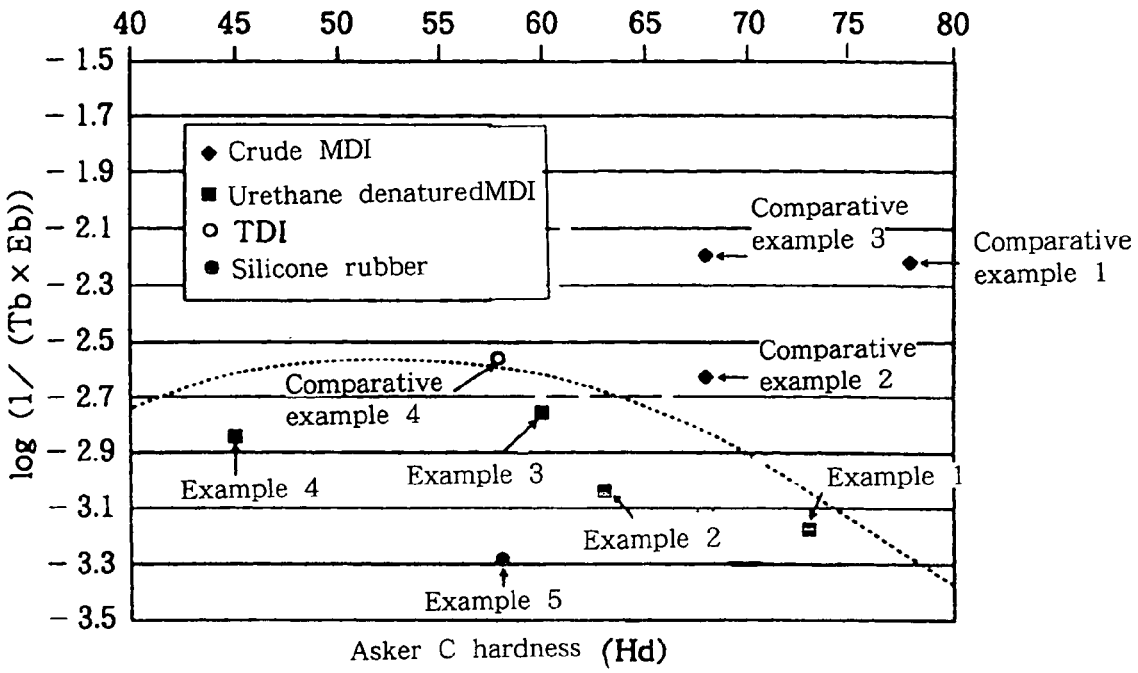
FIG. 3 is a graph showing the results of examples of the present invention in terms of the relationship between measurements of the Asker C hardness Hd and calculated values of $\log\{(Tb\cdot Eb)^{-1}\}$.

Each of the resulting rollers was fitted in an electrophotographic apparatus, which included a development assembly as shown in FIG. 3, to serve as a development roller 11.

A: Polyols obtained through the addition of propylene oxide/ethylene oxide to glycerol.

B: Polyols obtained through the addition of propylene oxide to ethylene glycol.

C: Polyols obtained through the addition of propylene oxide/ethylene oxide to glycerol.

D: Polyols obtained through the addition of propylene oxide to glycerol.

E: Polyols obtained from polyisoprene.

F: Polyols obtained through the addition of propylene oxide to glycerol.

G: 1,4-butandiol

H: Silicone elastomer (manufactured by SHIN-ETSU SILICONE CO., LTD.)

a: Polymethylene polyphenyl polyisocyanates (Millionate MR400, manufactured by NIHON POLYURETHANE KOGYO)

b: Polymethylene polyphenyl polyisocyanate (Lupranate MB9S, manufactured by BASF JAPAN)

c: Polymethylene polyphenyl polyisocyanate (Sumidule PF, manufactured by SUMITOMO BIEL URETHANE)

d: Trirene-diisocyanate (Koronate T80, manufactured by NIHON POLYURETHANE KOGYO)

As can be seen from Table 3, the elastic rollers of the examples having a value of $\log\{(Tb \cdot Eb)^{-1}\}$ which satisfies the aforementioned equation (1) can provide improved development rollers that are free of toner leakage caused by abrasion of the rollers.

These results are also shown in the graph in FIG. 3 in terms of the relationship between Asker C hardness Hd and $\log\{(Tb \cdot Eb)^{-1}\}$. In the graph, the horizontal axis corresponds to measurements of the Asker C hardness Hd and the vertical axis corresponds to calculated values of $\log\{(Tb \cdot Eb)^{-1}\}$. Points in the region under the dotted line satisfy the above-described equation (1). Development rollers using the elastic materials of the present invention which have their $\log\{(Tb \cdot Eb)^{-1}\}$ values in this region have proven to exhibit an improved sealing performance as did the rollers in the above-described examples.

Example 6

A polyol composition was prepared by blending 2.85 parts by weight of acetylene black into 100 parts by weight of polyisoprene polyol (OH value: 47.1) having a molecular weight of 2500, and mixing the mixture using a mixer. The polyol composition was stirred under reduced pressure to remove bubbles contained therein. 13.33 parts by weight of crude MDI (crude m-xylylene diisocyanate) (NCO weight %: 31.7) were added to the composition and the mixture was stirred for 2 minutes. 0.001 parts by weight of dibutyl tin dilaurate were then added to the mixture and the mixture was further stirred for 3 minutes. The mixture was then poured into a mold in which a metal shaft was preliminarily placed and which was preheated to 90° C. A roller was obtained by allowing the composition to harden at 90° C. for 12 hours to form a conductive elastic layer on the surface of the metal shaft. The surface of resulting roller was abraded to have an average surface roughness of 8 μmRz in accordance with the 10-point scale JIS standard and a thickness of 3 mm of the conductive elastic layer. The asker C hardness of the conductive elastic layer of the roller was 65°.

A coating liquid was prepared by dissolving 15 weight parts of oil-free alkyd resin and 5 weight % of melamine resin in toluene and subsequently adding and dispersing 10 weight parts of carbon black with respect to 100 weight parts of the resin components. The roller obtained above was dipped in the coating liquid and was taken out of the liquid. The roller was heated at 100° C. for 5 hours to allow the resin coating layer to harden by formation of cross-linkages. This completed the roller.

The roller so obtained was installed in a development unit for an imaging apparatus as shown in FIG. 2 as the developer roller 1 in such a manner that the layer forming blade 8 is pressed onto the roller with a line pressure of 80 g/cm$^2$. The development unit only was left for 3 days in an environment under a temperature of 30° C. and relative humidity of 85%. The development unit was then mounted in an imaging apparatus as shown in FIG. 2 and the apparatus was operated to produce images.

The roller was evaluated for the following properties.

(i) Roller Resistance

The roller was pressed against a copper plate by applying 500 g load on either end thereof, and measurements were taken using an R8340A resistivity meter (manufacutured by Advantest Co., Ltd.) while applying a voltage of 100V.

(ii) Roller Hardness

Samples in the form of sheets were prepared in the same manner as each roller. The samples were tested for hardness using an Asker C hardness meter (manufactured by Kobunshi Keiki Co., Ltd.) while applying a load of 1 kg.

(iii) Compressive Permanent Set

Samples in the form of sheets were prepared in the same manner as each roller.

Measurements were taken in accordance with JIS-K6301.

(iv) Evaluation of Image

Development units after being left for 3 days in an environment under a temperature of 30° C. and relative humidity of 85% were used. Using non-magnetic single component toner having an average particle size of 7 μm, imaging apparatus with the development unit installed was operated to produce solid black images and halftone images by reverse development while rotating the development unit at a circumferential speed of 110 mm/sec. The operation was continued until 5000 sheets of paper were printed, and changes in the rollers were observed. Those rollers that generated nip lines at an early stage of printing were evaluated only for early-printed images.

Example 7

Rollers were prepared and evaluated in the same manner as in Example 1 except that conductive elastic layer had a thickness of 1 mm. The results are shown in Table 2 below.

Example 8

The components listed below were mixed by stirring, poured into a mold heated to 110° C. and allowed to harden for 2 hours to form a conductive elastic layer on the surface of a metal shaft.

Components of Conductive Elastic Layer polyether polyol (MW 5000, OH value 33) 100 weight parts 1,4-butane diol 2.0 weight parts silicone surfactants 1.5 weight parts nickel acetyl acetonate 0.5 weight parts dibutyl tin dilaurate 0.01 weight parts acetylene black 2.0 weight parts urethane denatured MDI (NCO wt %: 23) 20 weight parts The above-described molded product was abraded in the same manner as in Example 6 to a roller having conductive elastic layer of 1 mm thickness. The resin coating layer was formed on the roller and the roller was similarly evaluated as a developer roller. The results are shown in Table 2.

Example 9

A roller was prepared and evaluated in the same manner as in Example 8 except that 1,4-butane diol was not used as a component of elastic layer and conductive elastic layer had a thickness of 3 mm. The results are shown in Table 2.

Example 10

A roller was were prepared and evaluated in the same manner as in Example 9 except that conductive elastic layer had a thickness of 1 mm. The results are shown in Table 2.

Comparative Example 5

A roller was prepared and evaluated in the same manner as in Example 8 except that conductive elastic layer had a thickness of 4 mm. The results are shown in Table 2.

TABLE 2

| | Roller resistance (Ω) | Thickness T (mm) | Hardness Hd (°) | Compressive permanent set S (%) | S · T/Hd | Early-printed images | Changes in roller after printing 5000 sheets |
|---|---|---|---|---|---|---|---|
| Example 6 | $5.5 \times 10^6$ | 3 | 65 | 5.0 | 0.23 | good | None |
| Example 7 | $2.0 \times 10^6$ | 1 | 78 | 5.0 | 0.064 | Good | None |
| Example 8 | $7.5 \times 10^5$ | 1 | 72 | 2.5 | 0.347 | Good | None |
| Example 9 | $4.5 \times 10^5$ | 3 | 74 | 2.0 | 0.031 | good | None |
| Example 10 | $2.0 \times 10^6$ | 1 | 85 | 2.0 | 0.024 | moderately good | None |
| Comparative Example 5 | $7.5 \times 10^6$ | 4 | 60 | 2.5 | 1.67 | nip line observed | — |

While the presently preferred embodiments of the present invention have been shown and described, it is to be understood that these embodiments are only illustrative and not exhaustive, and that various changes and modifications may be made by those skilled in the art without departing from the scope of the invention as set forth in the appended claims.

What is claimed is:

1. A developer roller comprising:

a shaft; and an elastic layer disposed about the shaft, the elastic layer comprising an elastic material that satisfies equation (1):

$$\log\{(Tb \cdot Eb)^{-1}\} \leqq -0.0011(Hd)^2 + 0.1154(Hd) - 5.6 \quad (1)$$

wherein: Tb is the tensile strength of the material ($N/mm^2$),

Eb is the tension fracture elongation (%) and

Hd is the Asker C hardness (°), and Hd is in a range from 50° to 80°.

2. The developer roller according to claim 1, wherein the elastic material satisfies equation (2):

$$\log\{(Tb \cdot Eb)^{-1}\} \leqq -0.0011(Hd)^2 + 0.1154(Hd) - 5.7 \quad (2).$$

3. The developer roller according to claim 1, wherein the elastic material has the Asker C hardness Hd in a range from 58° to 80°.

4. The developer roller according to claim 1, wherein the elastic material has the tensile strength Tb greater than or equal to $0.8 N/mm^2$.

5. The developer roller according to claim 1, wherein the elastic layer has the tension fracture elongation Eb greater than or equal to 50%.

6. The developer roller according to claim 1, wherein the elastic material is a polyurethane.

7. The developer roller according to claim 1, further comprising a toner provided on an outermost surface of the elastic roller.

* * * * *